US006138874A

United States Patent [19]

Audrey

[11] Patent Number: 6,138,874

[45] Date of Patent: Oct. 31, 2000

[54] DISPENSER FOR FLUIDS AND PAPER TOWELS

[76] Inventor: Ann M. Audrey, 14 Melody La., Irvine, Calif. 92614

[21] Appl. No.: 09/453,597

[22] Filed: Nov. 29, 1999

Related U.S. Application Data

[63] Continuation-in-part of application No. 09/056,881, Apr. 9, 1998, abandoned.

[51] Int. Cl.[7] ..... B67D 1/07

[52] U.S. Cl. ..... 222/192; 221/45; 222/321.9; 222/383.5; 222/385

[58] Field of Search ..... 221/96, 199, 45; 222/192, 321.7, 321.9, 383.1, 385

[56] References Cited

U.S. PATENT DOCUMENTS

| | | | |
|---|---|---|---|
| 2,746,798 | 5/1956 | Wardell | 239/274 |
| 4,436,224 | 3/1984 | McInerny | 222/192 |
| 5,465,878 | 11/1995 | Armijo et al. | 222/192 |
| 5,671,872 | 9/1997 | Daniels | 222/192 |
| 5,819,989 | 11/1998 | Saraceni | 222/192 |

*Primary Examiner*—Christopher P. Ellis
*Assistant Examiner*—Joe Dillon, Jr.
*Attorney, Agent, or Firm*—Dennis W. Beech

[57] ABSTRACT

The dispenser for fluids and paper towels is a combination fluid container and wiper dispenser having a base portion from the top center portion of which extends upwardly a neck tube having at its top an opening. The neck tube is sized such that a paper towel roll may be placed on the neck tube and rest on the base portion. The base portion and neck tube are hollow forming the fluid chamber and a mechanical pump device with siphon tube is attached to the top of the tube for dispensing fluid. The neck tube is extended to provide for ease in holding the dispenser in one hand while performing a cleaning operation.

10 Claims, 6 Drawing Sheets

DISPENSER FOR FLUIDS AND PAPER TOWELS

This is a continuation-in-part of application Ser. No. 09/056,881 filed Apr. 9, 1998, now abandoned.

BACKGROUND OF THE INVENTION

1. Field of the Invention

This invention relates to devices used for dispensing cleaning fluids and wipers for use in the general activity of cleaning objects, surfaces and the like. The new device provides a convenient container to transport fluid and wipers to a location to be cleaned in an easy portable combination.

2. Description of Related Art

There are currently known various devices for dispensing cleaning fluids and wipers such as paper towels for use in cleaning. An example of such a device is disclosed in U.S. Pat. No. 4,436,224, issued Mar. 13, 1984. In such devices the fluid is held in a dispenser which has an elongated neck attached to a relative broad base member all of which form the fluid chamber. A roll of wipers such as paper towels is placed on the elongated neck and rests on the base. A fluid dispensing fixture is then attached to the outlet aperture at the top of the elongated neck.

In this simple version the cleaning fluid and paper towels may be transported to a location to be cleaned. There is also provision for inserting the device in a case and for attaching the case to a support. A vertical slot is provided in the case for dispensing paper towels. Devices such as this and others currently known are bulky and not easily used when transported in the portable configuration to a site for cleaning.

Another example of the art is that disclosed in U.S. Pat. No. 5,819,989, issued Oct. 13, 1998. In this case a more compact dispenser is illustrated. The device again illustrates an elongated neck with various disclosures related to retaining member for inhibiting the unraveling of paper towels from the roll. However, the retaining members disclosed do not describe or anticipate a much similar more straight forward device for retaining the paper towels.

The present invention provides for a combination fluid container and wiper dispenser in a relatively lightweight, single hand grippable configuration for the user. The improved device has a hand grip portion on the elongated neck of the fluid container and the roll of towels or wipes may be shortened for proper sizing. In addition a simple handle may be placed on the elongated neck. The handle may be used to carry the dispenser, may be bowed inward with flexible construction to inhibit paper towel unraveling from the roll and to adjust to variable diameter rolls, may be augmented with an elastic retaining member for inhibition of paper towel unraveling, and may be structured to include a cutting edge to cut paper towels from the roll. A pouch may also be provided for disposal of soiled wipers.

SUMMARY OF THE INVENTION

One object of the present invention is a combination fluid container and wiper holder with a user hand grip for operating a fluid dispensing apparatus. Another object is to incorporate a retractable hand grip. An additional object is a resilient carry handle formed to inhibit paper towel unraveling from a roll. Another object is augmentation of a carry handle with a resilient retaining member to inhibit paper towel unraveling. A further object is provision of a carry handle with wiper tearing edge. Another object is to provide a wiper disposal container. An additional object is to allow storage of the device with access to the roll of wipes.

In accordance with the description presented herein, other objectives of this invention will become apparent when the description and drawings are reviewed.

DESCRIPTION OF THE PREFERRED EMBODIMENT

The dispenser for fluids and paper towels consists of a base element and a connected elongated neck element which form a collective chamber or hollow cavity for holding a fluid. A roll of towels made of paper or other suitable material is placed on the neck element. The neck element extends above the top of the roll of paper towels such that it may be gripped by the user's hand for holding the dispenser and operating an attached fluid dispensing apparatus. The roll of towels may be sized in the longitudinal or height dimension for a compact dispenser.

Figure 1:
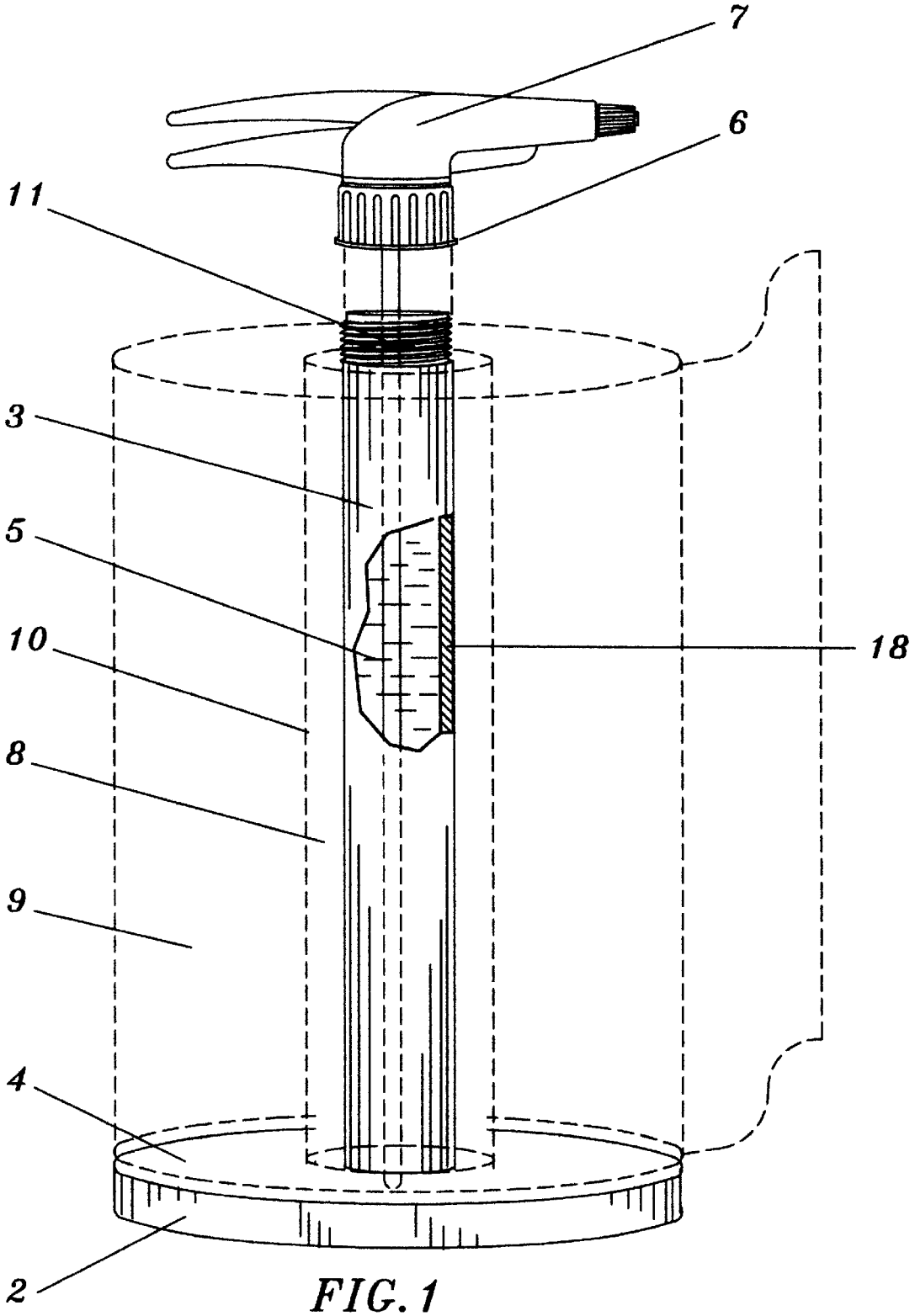
FIG. 1 illustrates a perspective elevation view of the dispenser with accordion neck portion compacted.
Figure 2:
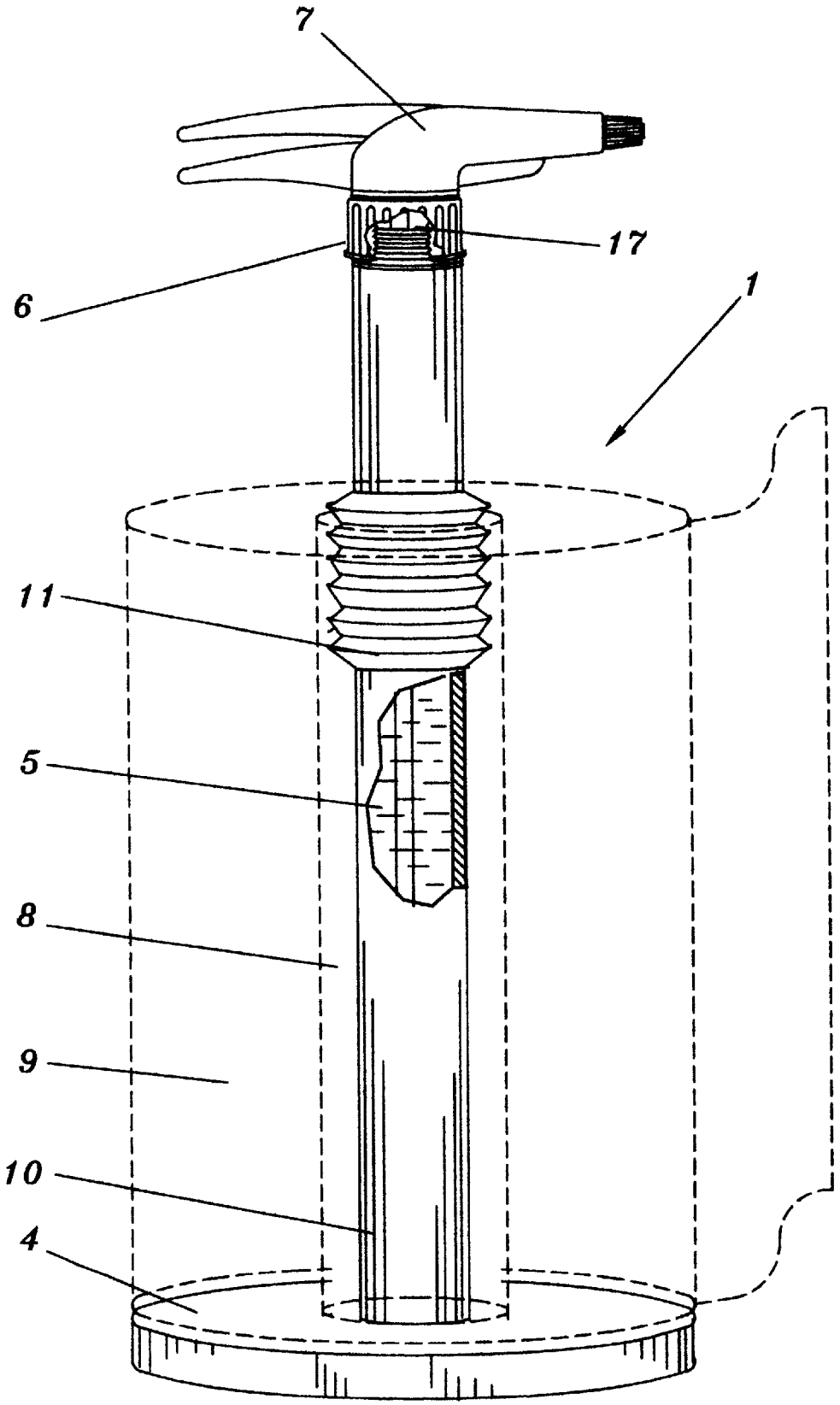
FIG. 2 illustrates a perspective elevation view of the dispenser with accordion neck portion elongated.

Referring to FIGS. 1 and 2, the dispenser (1) has a base element (2) and an attached cylindrical neck element (3) which extends upwardly from the center of the top wall (4) of the base element (2). The base element (2) and neck element (3) having a hollow cavity therein forming a fluid chamber (5) for holding a cleaning fluid.

The neck element (3) terminates in a threaded reduced neck top portion (6) having an outlet aperture (17). To this neck top portion (6) a fluid dispensing apparatus (7) is attached. The fluid dispensing apparatus (7) is of the hand mechanical pump type having a siphon tube (18) extending into the fluid chamber (5).

The neck element (3) is sized to fit into the central bore (8) of a roll (9) of paper towels. The paper towels are normally wrapped around a central cylindrical core (10) of a cardboard tube having a central bore (8). With the roll (9) installed on the neck element (3) the user has a combination cleaning fluid container and wipers holder which may be easily transported to a cleaning site.

Figure 3:
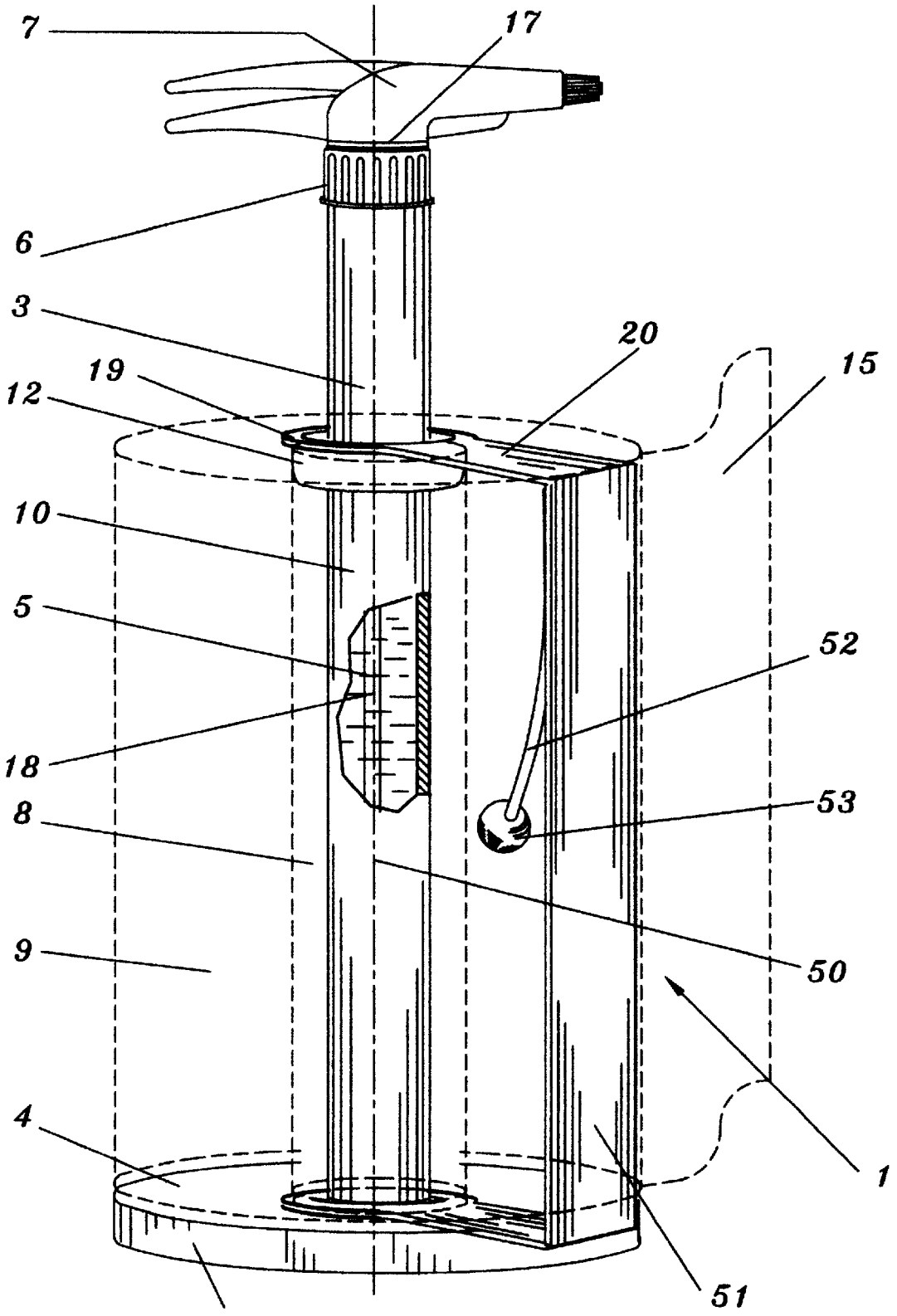
FIG. 3 illustrates a perspective elevation view of the dispenser with elongated neck and wiper roll holding ring.

The neck element (3) has longitudinal length as measured along the center line (50) illustrated in FIG. 3 to accommodate a roll (9) of towels which roll (9) is preferably approximately one half or less the longitudinal length of the standard paper towel roll of eleven to twelve inches. The eight inch or less length roll (9) of towels and the corresponding length neck element (3) make a compact device which is not bulky or cumbersome to use. If longer sheets of paper towels are desired, the perforations for tearing the paper towels from the roll (9) may be spaced further apart and while keeping the length of the paper towel roll to the shorter dimension.

In the instance of FIGS. 1 and 2 the neck element (3) has an accordion section (11) intermediate the base element (2) and the neck top portion (6). When the accordion section

(11) is compressed, the neck element (3) extends just above the top of the roll (9). Alternately when the accordion section (11) is extended, the neck element (3) is elongated as in FIG. 2 such that it may be easily gripped by a users hand. This provides for ease in holding the dispenser (1), applying cleaning fluid to a site using the fluid dispensing apparatus and removing paper towels while holding the dispenser (1).

FIG. 3 illustrates an alternate version of the dispenser (1) wherein the neck element (3) is permanently elongated for ease of gripping by the user. In this instance an annular ring (12) is attached to the neck element (3) intermediate the base element (2) and the neck top portion (6). The annular ring (12) serves as a retainer for the roll (9) and rest for the users hand. FIG. 3 also illustrates the use of a carry handle (13) which is slidably engaged with the neck element (3) by, for example, provision of arm apertures (19) on arms (20) which slide on neck element (3) and are retained thereby. The arms (20) are joined by a longitudinal handle element (51). The handle element (51) may be constructed of a resilient material to allow deformation when griped by a user's hand to carry the dispenser (1). The handle element (51) may also be bowed inward toward the neck element (3) to press against a roll (9) as the paper towels (15) are removed and thereby decrease the roll (9) diameter. This use would inhibit paper towel (15) unraveling from the roll (9).

The carry handle (13) may also be augmented with a resilient retaining member (52) which is attached to the carry handle (13) and is curved inward toward the neck element (3) ending in a retainer end (53) for engagement with the roll (9). This is an alternate structure to inhibit paper towels (15) from unraveling. The retaining member (52) may be cylindrical, as illustrated in FIG. 3, or may be rectangular as illustrated for the handle element (51) or other suitable shape. Also as in the instance of a cylindrical or wire like retaining member (52), the carry handle (13) may also be of cylindrical shape. The retainer end (53) may include a bushing formed as a ball as illustrated, may simply include a bend to avoid a sharp edge contacting the roll (9) or like means for providing a low friction contact.

Figure 4:
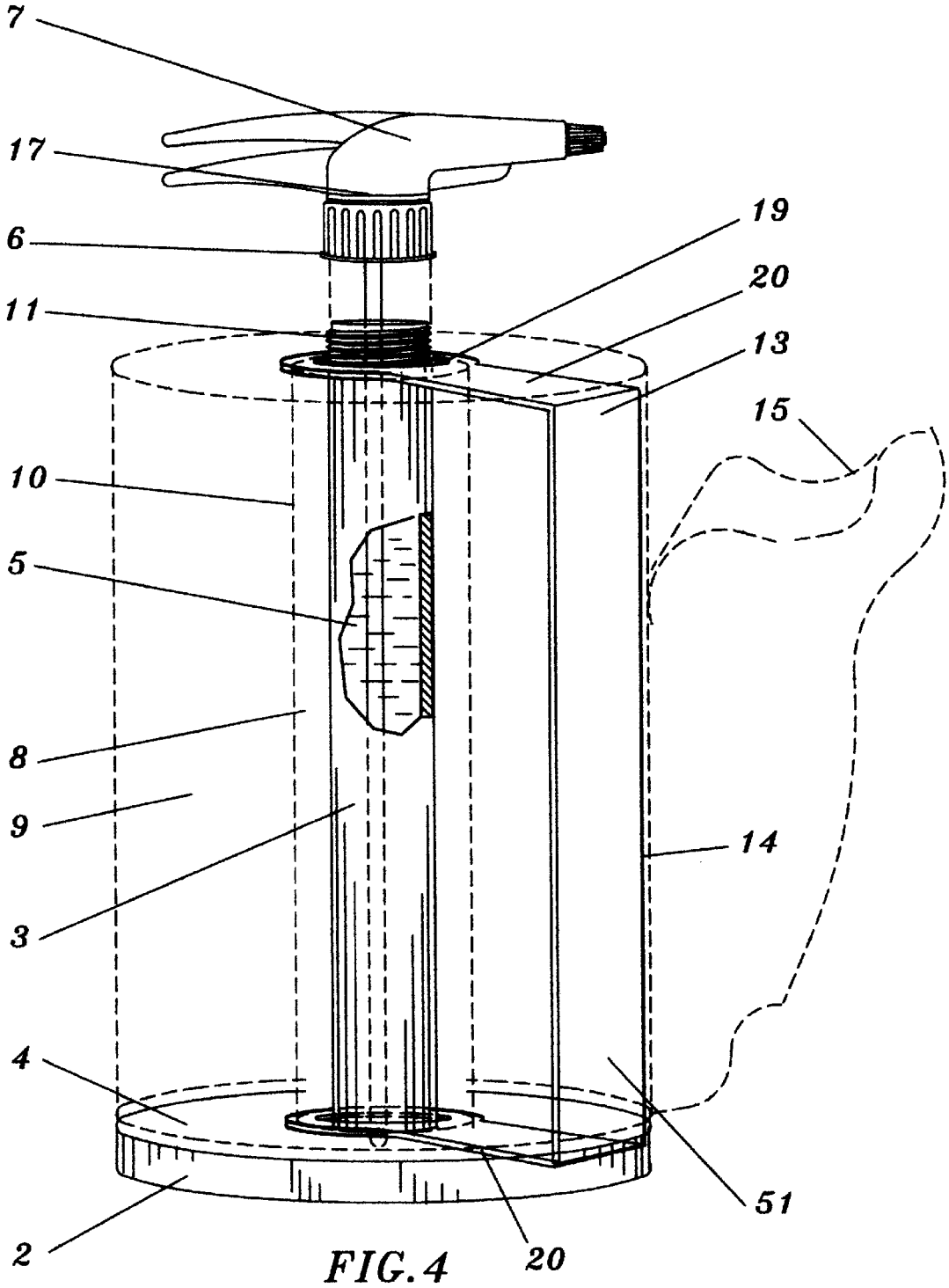
FIG. 4 illustrates a perspective elevation view of the dispenser with carry handle.
Figure 5:
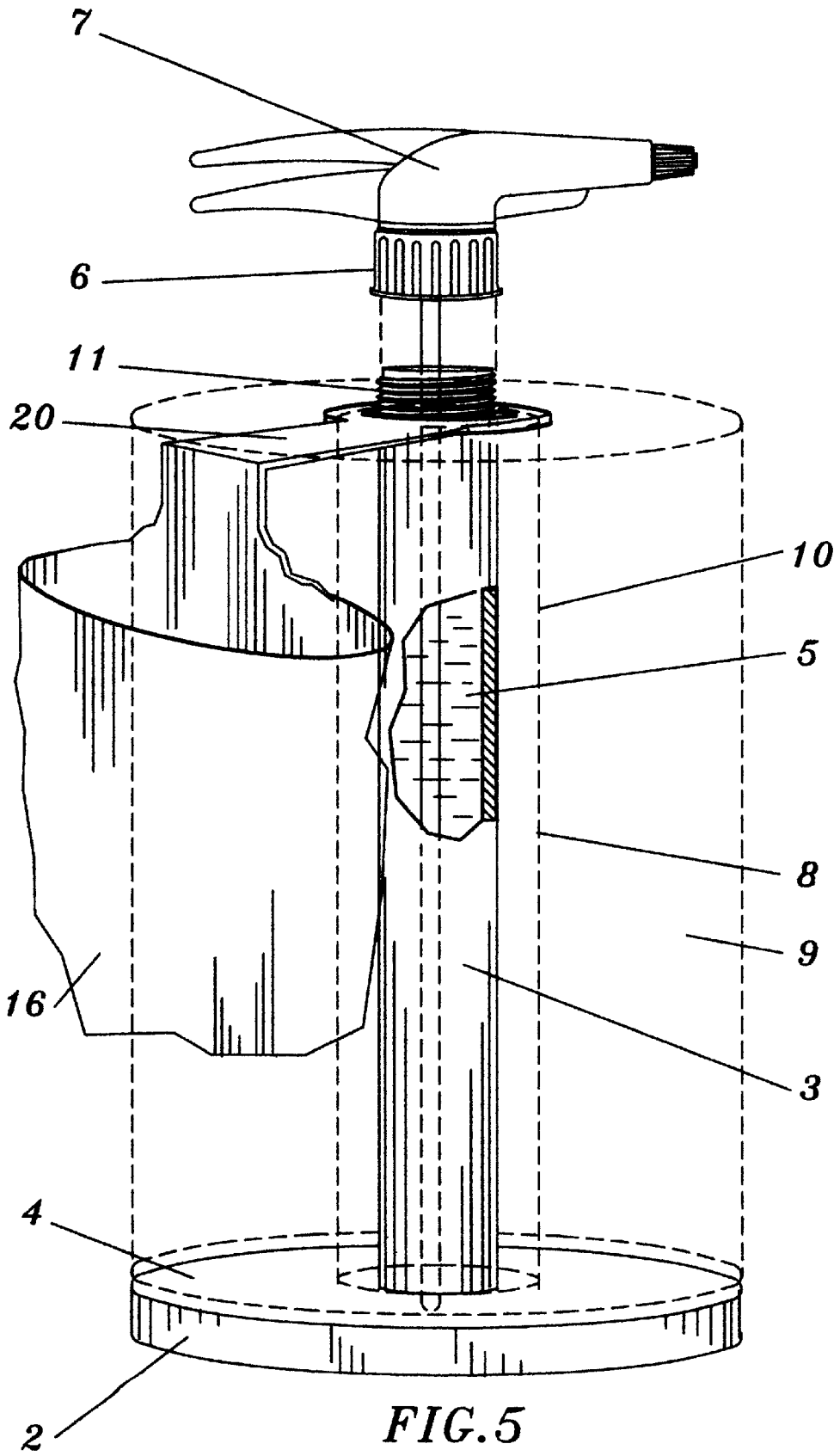
FIG. 5 illustrates a perspective elevation view of the dispenser with wiper disposal container.

Referring to FIGS. 4 and 5, attachments are illustrated for use in carrying the dispenser (1) and for disposing of soiled towels. Carry handle (13) is attached to the neck element (3) by, for example, provision of arm apertures (19) on arms (20) which slide on neck element (3) and are retained thereby. There is a tearing edge (14) which may be used to dispense paper towels (15). In addition a wiper disposal container (16) may be placed on the neck element (3) as illustrated in FIG. 5 or at the bottom of the roll (9) thereby resting on the base element (2).

The preferred embodiment has been described and illustrated with certain proportions. However, it may be proportioned differently as for example where use is intended with a paper towel roll (9) which is a different length longitudinally or in height or has less wipes and is thus thinner.

Figure 6:
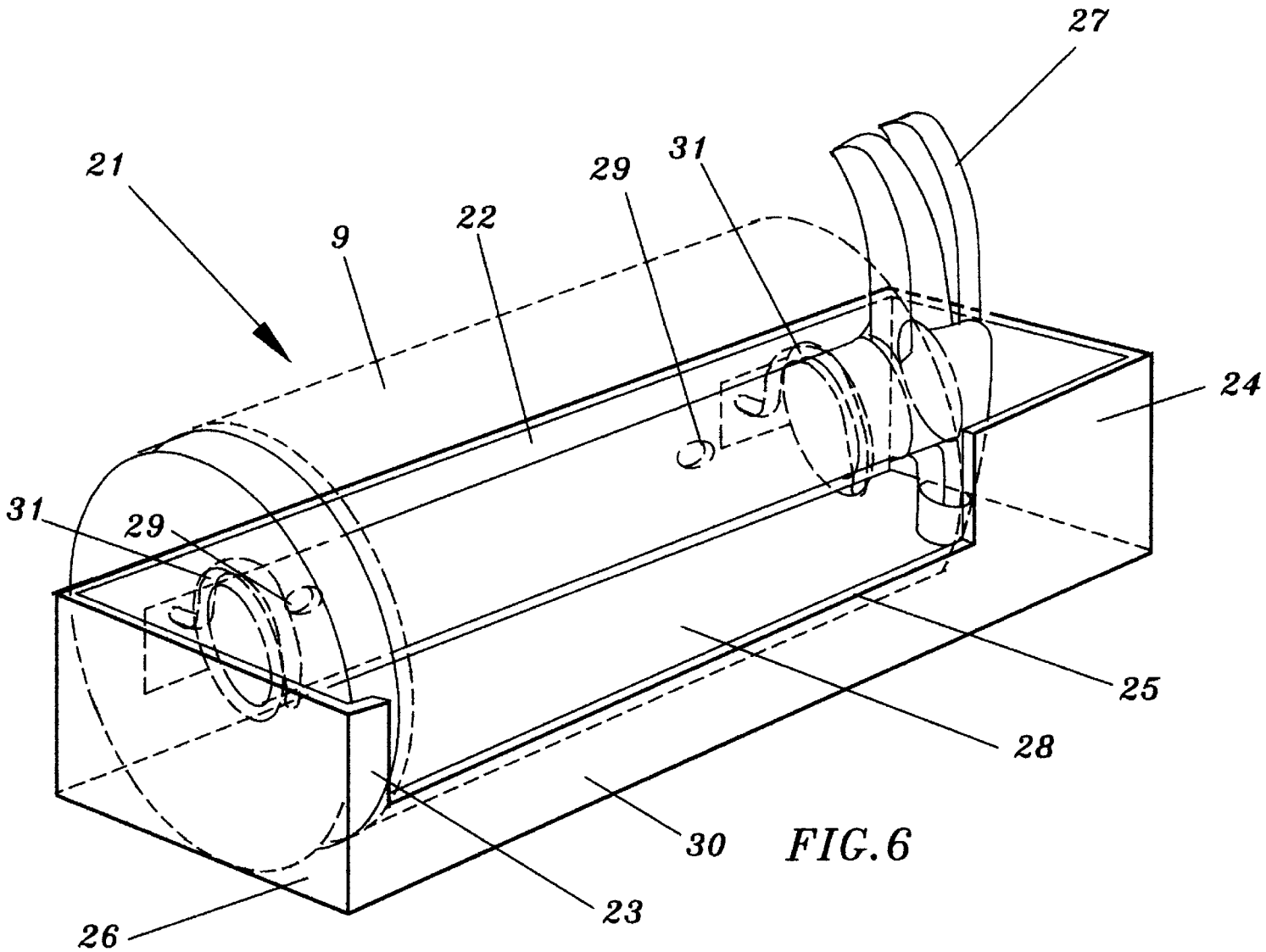
FIG. 6 illustrates a perspective elevation view of the dispenser in the mounting bracket.

Referring to FIG. 6, the dispenser (1) is shown as placed in a mounting bracket (21) which is generally a rectangular trough shape open at the top. The mounting bracket (21) has a back plate (22) with mounting holes (29) and a bottom plate (28) both joined by a top end element (27) and bottom end element (26). The front face element (30) has a bottom tab (23) and top tab (24) to retain the dispenser (1) at the base element (2) and fluid dispensing apparatus (7) respectively. In addition a lip element (25) is provided over which to pull paper towels (15) to be torn or detached. If it is desired to attach the mounting bracket (21) in a vertical orientation (not shown), clips (31) may be added to the back plate (22) to retain the dispenser (1).

While the invention has been particularly shown and described with respect to the illustrated and preferred embodiments thereof, it will be understood by those skilled in the art that the foregoing and other changes in form and details may be made therein without departing from the spirit and scope of the invention.

I claim:

1. A device for holding fluid and wipers comprising:

a base element attached to a neck element which extends upwardly from the center of a top wall of the base element;

the neck element at a neck top portion thereof having an outlet aperture defined therein and a means for attachment of a fluid dispensing apparatus;

the base element and the neck element are hollow thereby forming a fluid chamber;

the neck element sized to receive a roll of wipers with a central bore therein; and a carry handle having a pair of arms with apertures defined therein for mounting on the neck element and each arm attached at approximately a right angle to a handle element of said carry handle to span the longitudinal length of the roll of wipers.

2. The device as in claim 1 wherein the carry handle has a retaining member attached thereto in a position for a retainer end of said retaining member to press against the roll and the retaining member formed of a resilient material with an inward curved shape.

3. The device as in claim 1 wherein the neck element is sized to receive a roll of wipers having longitudinal length up to eight inches.

4. The device as in claim 1 wherein an annular ring is attached to the neck element intermediate the base element and the neck top portion.

5. The devise as in claim 1 wherein the carry handle having a tearing edge.

6. The device as in claim 1 wherein a wiper disposal container is attached to the neck element.

7. The device as in claim 1 wherein the handle element is formed of resilient material.

8. The device as in claim 7 wherein the handle element is formed with an inward bow shape.

9. The device as in claim 1 wherein there is a mounting bracket for receipt and holding of the device comprising;

a generally rectangular shaped trough with a back plate and a bottom plate with a top end element and a bottom end element attached.

10. The device as in claim 9 wherein there are a pair of clips attached to the back plate to engage the neck element.

* * * * *